US007314342B2

(12) United States Patent
Kerwin

(10) Patent No.: US 7,314,342 B2
(45) Date of Patent: Jan. 1, 2008

(54) CEMENT HOPPER ATTACHMENT FOR SKID STEER LOADER

(76) Inventor: Steven M. Kerwin, 12150 Hwy 92, Platte City, MO (US) 64079

( * ) Notice: Subject to any disclaimer, the term of this patent is extended or adjusted under 35 U.S.C. 154(b) by 116 days.

(21) Appl. No.: 11/328,435

(22) Filed: Jan. 9, 2006

(65) Prior Publication Data

US 2007/0160452 A1 Jul. 12, 2007

(51) Int. Cl.
*B66F 9/00* (2006.01)

(52) U.S. Cl. ..... 414/722; 37/419; 222/410; 222/610; 414/725

(58) Field of Classification Search ..... 414/722, 414/724, 725, 680, 912; 37/903, 419; 222/460, 222/461, 462, 610
See application file for complete search history.

(56) References Cited

U.S. PATENT DOCUMENTS 5,182,057 A * 1/1993 Johnson ..... 264/31
5,829,949 A * 11/1998 Brown ..... 414/725
2005/0155993 A1* 7/2005 Bieker ..... 222/610

OTHER PUBLICATIONS

CNH AMERICA, LLC., "Concrete Chuters" New Holland Website, 2005, 1 page.
Bobcat Company, "Dumping Hopper" Bobcat website, 2005, 3 pages.

* cited by examiner

*Primary Examiner*—Donald Underwood
(74) *Attorney, Agent, or Firm*—R. Tracy Crump

(57) ABSTRACT

The cement hopper attachment includes a raised hopper supported atop two uprights extending from a rectangular base. The hopper has a forward mounted gate and cement chute. A hydraulic cylinder operatively connected to the skid steer's auxiliary hydraulic controls actuates the gate of the hopper. The shape and configuration of the hopper is design to provide an unobstructed view from the skid steer of the cement dispensed from hopper. The hopper attachment also includes a pair of retractable support wheels, which support the weight of the loaded hopper attachment and prevent rocking and tipping forward under the weight of the loaded hopper attachment.

11 Claims, 7 Drawing Sheets

CEMENT HOPPER ATTACHMENT FOR SKID STEER LOADER

This invention relates to an attachment for skid steer loaders, and in particular a cement hopper attachment, which allows a load of cement to be carried and dispensed by a skid steer loader.

BACKGROUND OF THE INVENTION

Utility attachments for skid steer loaders ("skid steers") have been developed for a variety of applications, ranging from backhoes and bale handlers to stump grinders and snow blowers. These attachments greatly enhance the productivity and utility of the skid steers. To accommodate these different utility attachments, conventional skid steers are designed with universal mounting mechanisms that allow the attachment to be quickly fitted to the skid steers and hydraulic systems with auxiliary attachment fittings that can be used to operate certain utility attachments.

New Holland, a division of CNH Global of Lake Forest, Ill., manufacturers a utility attachment for cement work. This utility attachment allows the skid steer to transport and dispense a small load ( under a cubic yard) of wet cement and includes a small hopper and a short cement chute. Cement is dispensed from the hopper by actuating a gate that is operatively connected to the controls of the skid steer. While convenient for hauling and dispensing wet cement in some applications, this attachment is not well suited for concrete work where large volumes of wet cement must be dispensed over many locations in small amounts or dumps, such as providing cement for concrete fence post foundations. The carrying capacity of this attachment is limited because the boom arms of the skid steer support the weight of both the concrete chute attachment and the wet cement carried inside. The capacity of this attachment cannot be significantly increased without increasing the danger of tipping the skid steer. Also, the design of this attachment does not allow the operator of the skid steer to visually monitor the cement being dispensed. While the skid steer operator can actuate and control the gate to dispense the cement from the seat of the skid steer, the operator's view of the gate is obstructed by the hopper body. Consequently, an additional person is often needed to help direct the skid steer operator to position the cement chute at the desired location and to help monitor the cement as it is dispensed from the hopper.

SUMMARY OF THE INVENTION

The hopper attachment embodying this invention allows a skid steer to quickly and safely transport and dispense large volumes of wet cement. The shape and configuration of the hopper also provides an unobstructed view from the skid steer of the cement being dispensed from the hopper. The hopper attachment includes a raised hopper supported atop two uprights extending from a rectangular base. The hopper has a forward mounted gate and a cement chute. A hydraulic cylinder operatively connected to the skid steer's auxiliary hydraulic controls actuates the gate of the hopper. The hopper attachment also includes a pair of retractable support wheels, which support the weight of the loaded hopper attachment and prevent rocking and tipping forward under the weight of the loaded hopper attachment. The hopper attachment embodying this invention allows a skid steer operator to dispense cement without additional man power or assistance. The skid steer operator can visually monitor the wet cement being dispensed from the hopper while seated in the skid steer and control the actuation of the hopper gate using the skid steer's hydraulic controls.

Theses and other advantages of the present invention will become apparent from the following description of an embodiment of the invention with reference to the accompanying drawings.

BRIEF DESCRIPTION OF THE DRAWINGS

The drawings illustrate an embodiment of the present invention, in which.

DESCRIPTION OF THE PREFERRED EMBODIMENT

Figure 1:
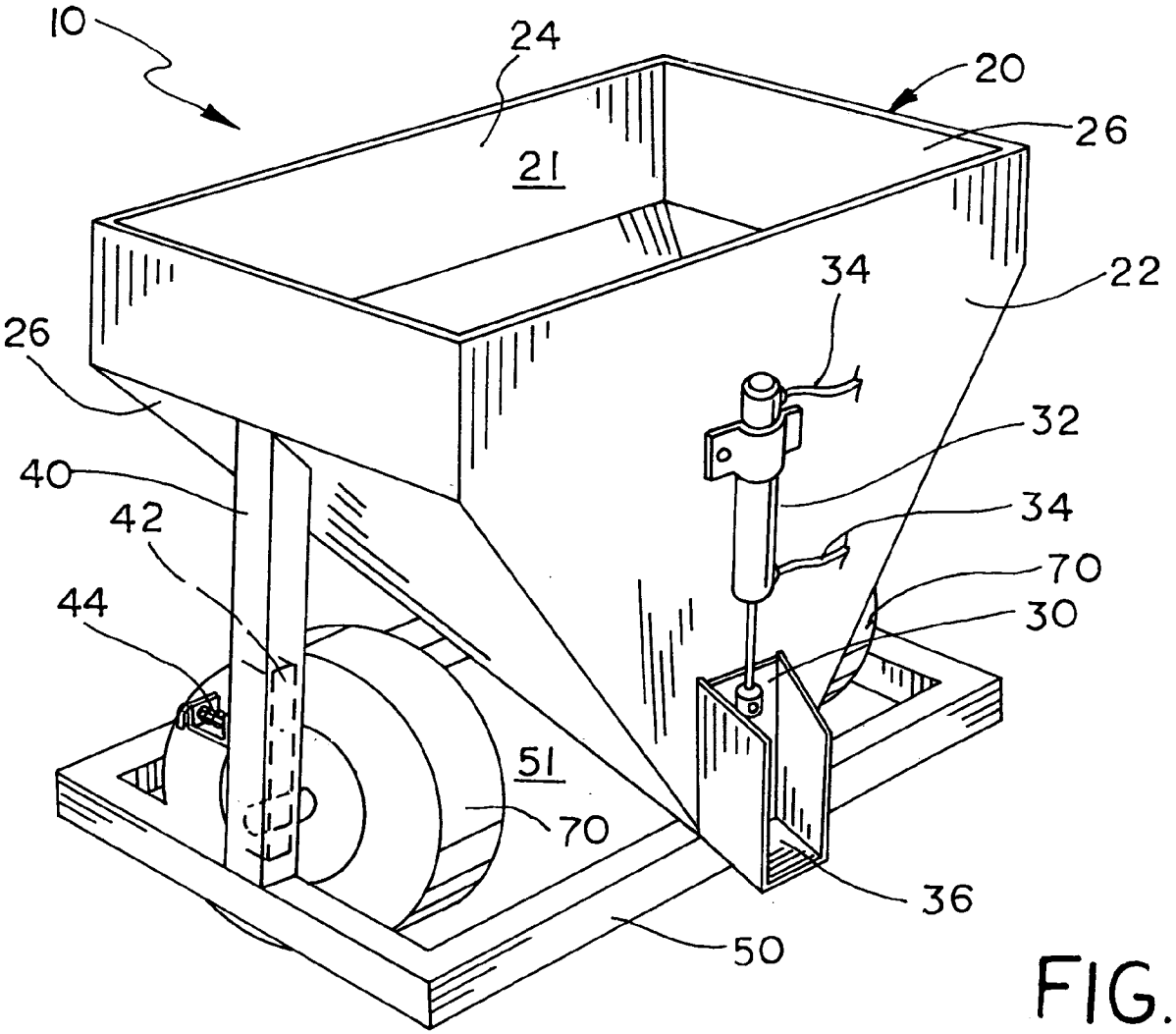
FIG. 1 is a perspective view of a cement hopper attachment embodying the teachings of this invention.
Figure 2:
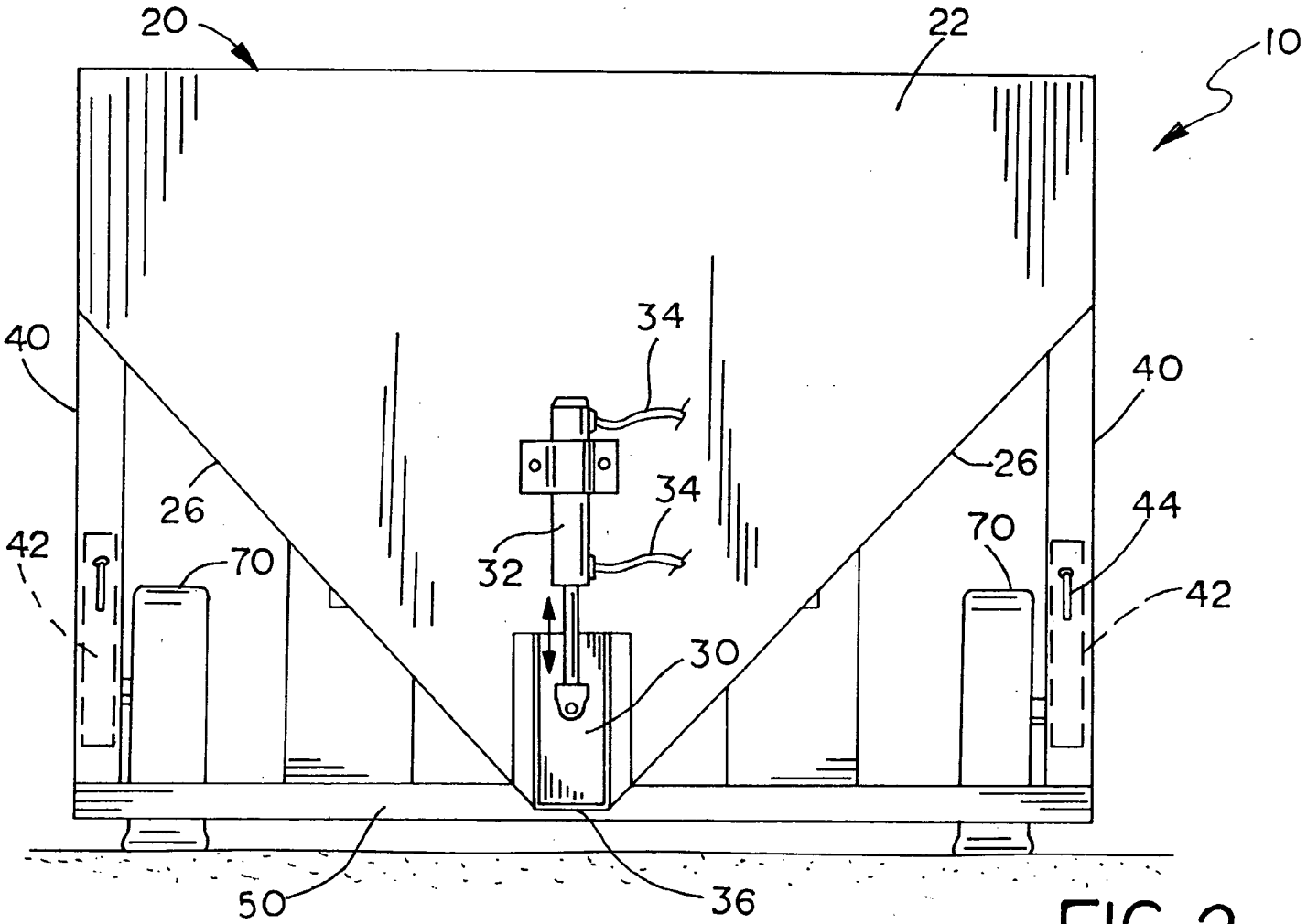
FIG. 2 is a front view of the attachment of FIG. 1.

Referring now to the drawings, the cement hopper attachment of this invention is generally designated as reference numeral 10. Hopper attachment 10 is designed and intended for use as an utility attachment for a conventional skid steer 2. The skid steer 2 illustrated and described herein is of conventional design and of the type well know in the industry. Skid steer 2 includes an operator cabin, a pair of articulated boom arms operated by hydraulic cylinders. Skid steer 2 also includes a universal attachment mounting mechanism and a hydraulic operation system, which allows different utility attachments to be mounted to the skid steer and actuated using its hydraulic controls.

Hopper attachment 10 includes a raised hopper 20 supported atop two uprights 40 extending from an open rectangular base frame 50. Hopper 20 has an interior 21 defined by a front wall 22, back wall 24 and two side walls 26. Front wall 22 has a diamond shaped configuration and an opening or mouth 23 at its vertex. Back wall 24 and side walls 26 each have a vertical rectangular top section and an inclined triangular bottom section. The bottom sections of back wall 24 and side walls 26 slant downward toward the vertex of front wall 22 and mouth 23. Mouth 23 is covered by a gate 30 which is raised and lowered by a hydraulic cylinder 32. Hydraulic lines 34 connect cylinder 32 to the hydraulic system of skid steer 2, which allows the operator to open and close gate 30. A cement chute 36 is mounted to front wall 22 around mouth 23 and extends outward past base frame 50.

Figure 3:
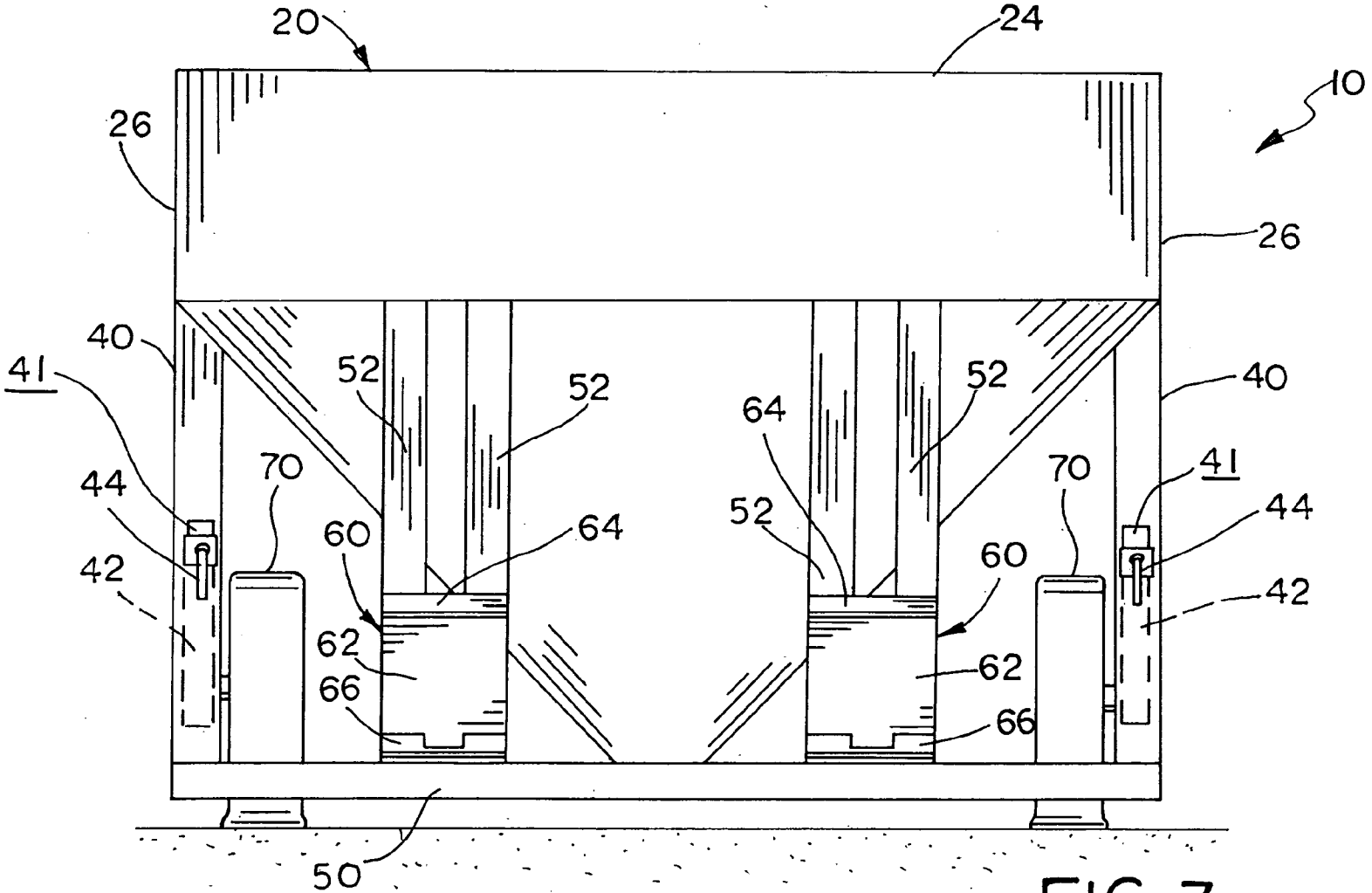
FIG. 3 is a back view of the attachment of FIG. 1.

Uprights 40 are constructed of heavy gauge rectangular steel tubing. Base frame 50 is constructed of heavy gauge steel C-channel. The sections of C-channel are joined end to end so that base frame 50 has an open interior. Uprights 40 extend vertically from the center of the side segments of base frame 50. Two mounting saddles 60 are welded to a pair of upright braces extending between the back of base frame 50 and the back of hopper 20. Hopper attachment 10 is designed and intended for connection to the universal attachment mounting and locking mechanisms of any conventional skid steer regardless of make or model. Mounting saddles 60 are configured and designed to operate with the universal attachment mounting mechanisms of conventional skid steers, which allow different utility attachments to be quickly and easily interchanged. Each mounting saddle 60 has a back 62, a down turned upper lip 64 and lower flange seat 66, which are configured to securely mate with a mounting plate of a skid steer's attachment mounting mechanism. As shown in FIG. 3, mounting saddles 60 are spaced apart to provide an open space therebetween.

Figure 4:
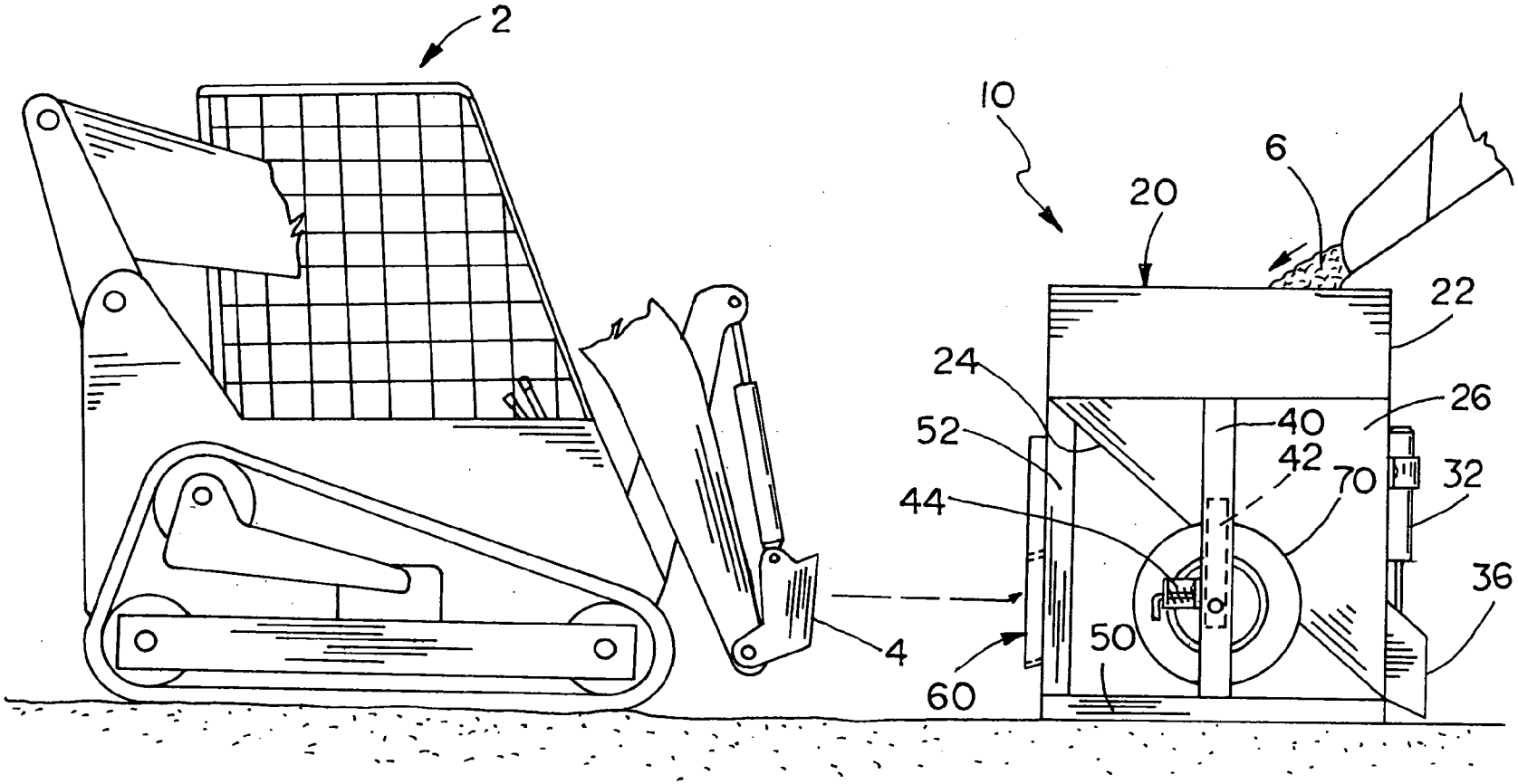
FIG. 4 is side view of the attachment of FIG. 1 showing the hopper being filled with cement and a conventional skid steer.
Figure 5:
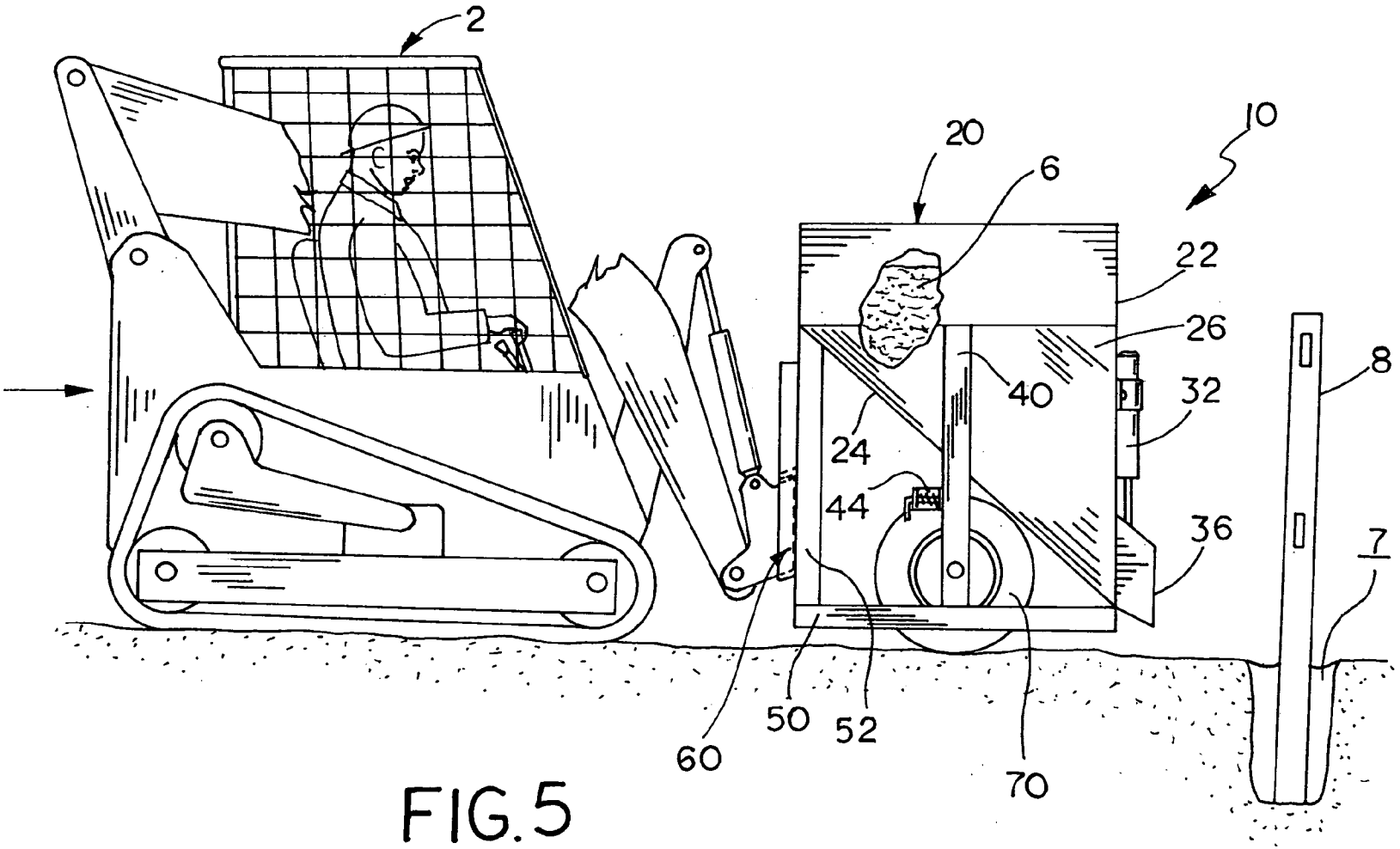
FIG. 5 is a side view of the attachment of FIG. 1 fitted to the skid steer.
Figure 6:
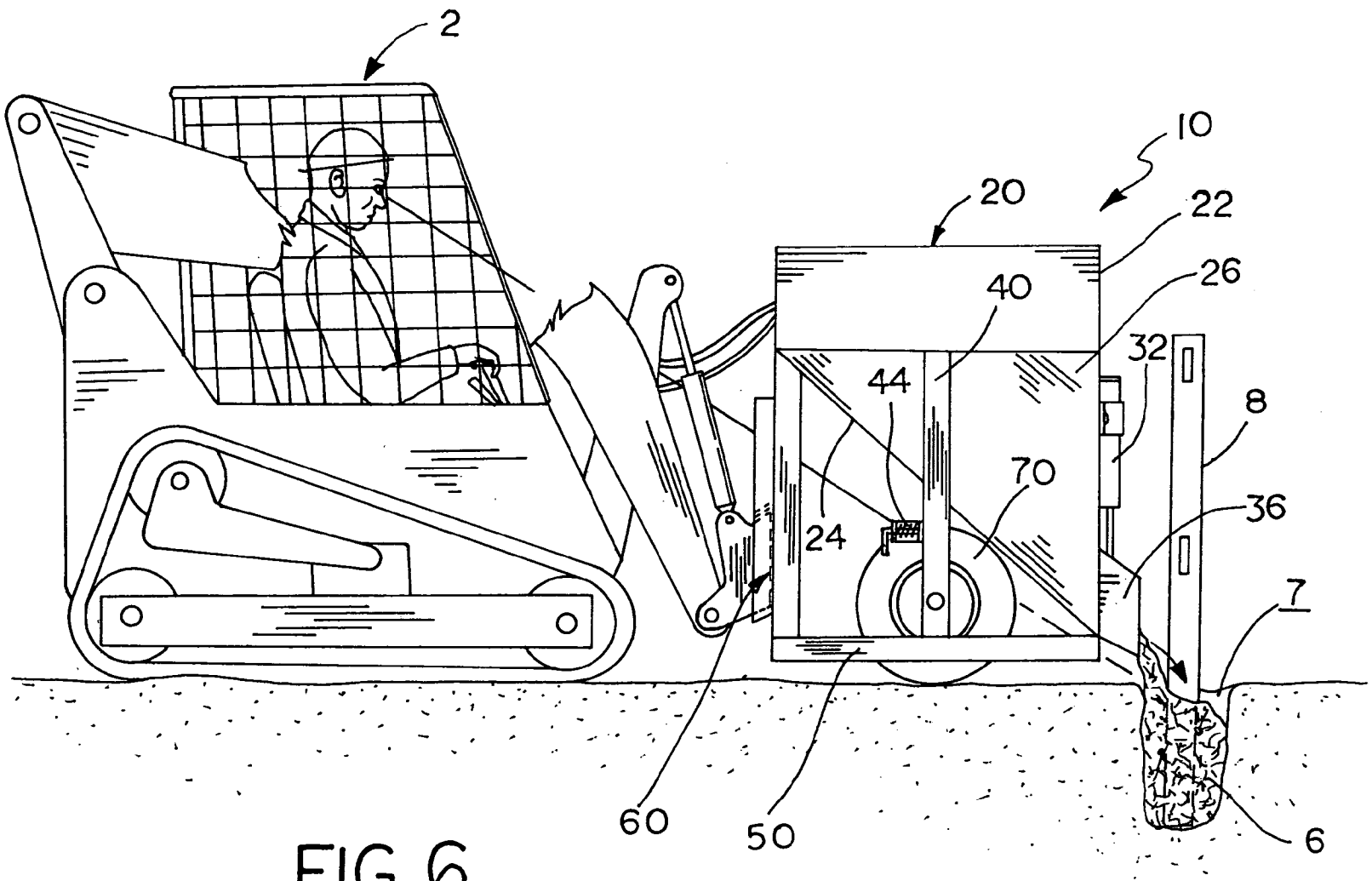
FIG. 6 is a side view of the attachment of FIG. 1 fitted to the skid steer and dispensing cement into a post hole around a fence post.

Attachment 10 also includes a pair of support wheels 70, which can be selectively moved between a retracted position (best illustrated in FIG. 4) and an extended position (best illustrated in FIGS. 5 and 6). Ideally, wheels 70 are large low pressure aircraft wheels, which can support the weight of the loaded hopper and not damage the ground over which the attachment travels. Wheels 70 are mounted on axles that extend through from slides 42 shiftably disposed within uprights 40 through vertical slots 41 in the uprights. Slides 42 allow support wheels 70 to be moved up and down between the raised and lowered positions. A spring loaded latch pin 44 extends through aligned holes (not shown) in uprights 40 and one of two holes (not shown) in slides 42 to secure slides 42 in place within upright 40.

FIGS. 4-7 illustrate attachment 10 used in a typical fencing application where wet cement 6 is dispensed into a post hole 7 around fence post 8. While a fencing application is illustrated, the use of attachment 10 is not limited to any specific application. As shown in FIG. 4, hopper 20 is loaded with wet cement when attachment 10 is not mounted to skid loader 2 and resting atop base frame 50 with support wheel 70 in the raised position. Although hopper 20 can be loaded with cement with the hopper attachment 10 already mounted to the skid steer, loading the hopper when the attachment is detached prevents wet cement from spilling to the operator's compartment and onto the operator. Once hopper 20 is filled, attachment 10 is mounted to skid steer 2. Typically, skid steer 2 is maneuvered so that mounting plate 4 engages mounting saddles 60. Once hopper attachment 10 is secured to skid steer 2, hydraulic lines 34 are connected to the accessory fittings (not shown) of skid steer 2 so that the operator can actuate gate 30 from the operator's compartment. Next, the operator raises hopper attachment 10 off the ground slightly so that support wheels 70 can be lowered and locked into their extended positions using latch pin 44. With support wheels 70 locked in the lowered position, the operator lowers hopper attachment 10 so that support wheels 70 ride on the ground and support the weight of the attachment. As shown in FIG. 5, the operator can now drive skid steer 2 to transport the load of wet cement to the desired location. As shown in FIG. 6, the operator maneuvers skid steer 2 to position chute 36 above post hole 7 and actuates gate 30 using the skid steer's hydraulic controls. Cylinder 32 raises gate 30 to dispense cement 6 into post hole 7.

ADVANTAGES

Figure 7:
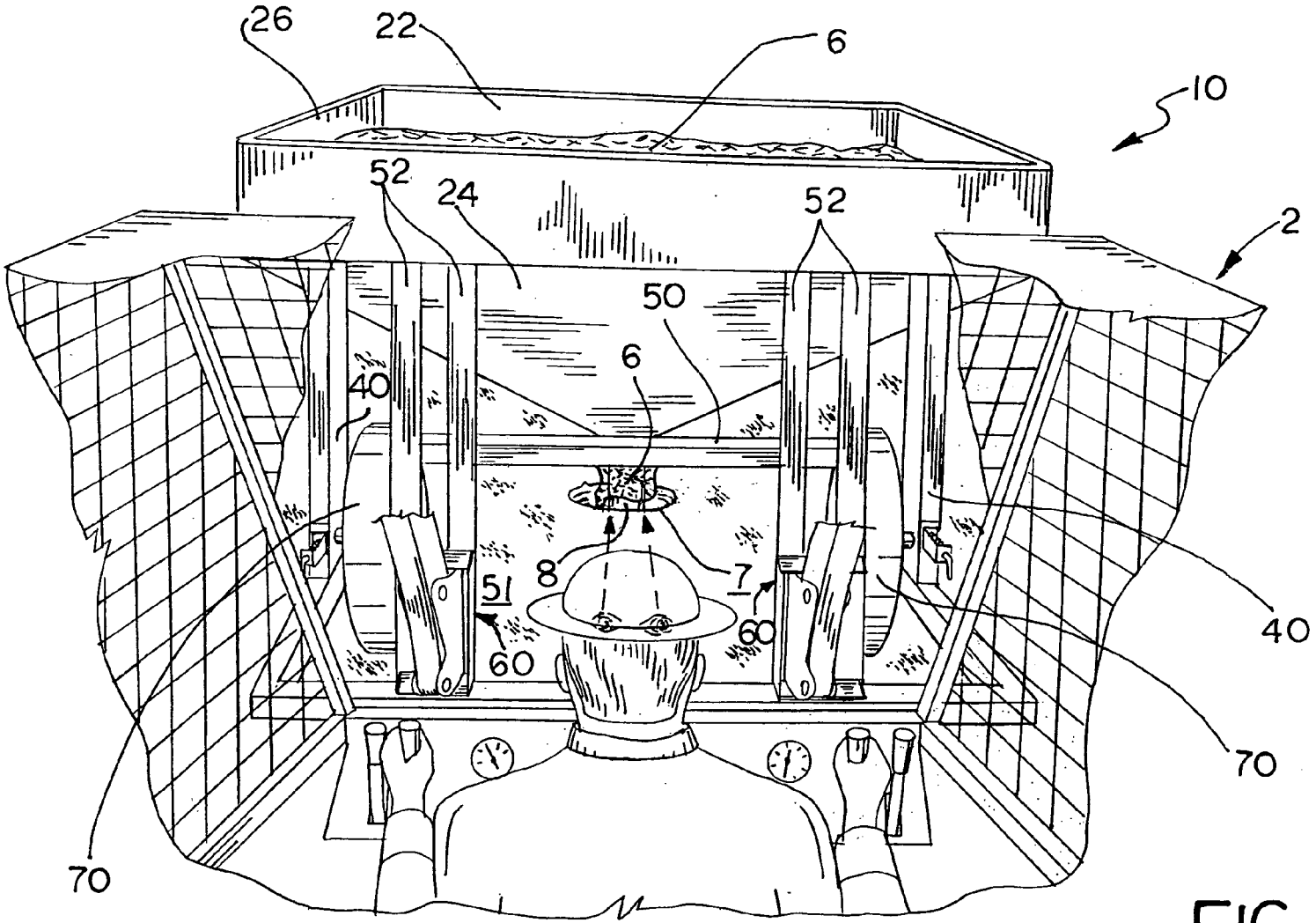
FIG. 7 is a view from behind the operator's head while seated in the skid steer of the back of the attachment of FIG. 1.

One skilled in the relevant arts will note several advantages of the hopper attachment embodying this invention over the prior art. The hopper attachment allows a skid steer operator to dispense cement without additional man power or assistance. As shown in FIG. 7, the open base frame design and hopper configuration allows a seated skid steer operator to visually monitor the cement being dispensed from the hopper. Because the hopper is elevated above the frame on the uprights and the hopper's back wall is sloped downward, the skid steer operator has a direct visual line of sight from a seated position in the skid steer under the hopper and through the base frame to the cement exiting the chute. The mounting saddles and support uprights are also spaced apart to provide an unobstructed view of the cement being dispensed from the hopper. Because the operator can control the actuation of the hopper gate using the skid steer's hydraulic controls and visually monitor the cement being dispensed from the operator's seat, no additional manpower is needed to guide or assist the operator.

The retractable support wheels of the hopper attachment also allow a skid steer to quickly and safely transport and dispense large volumes of wet cement. In the extended position, the weight of the loaded hopper attachment rides on the support wheels. The support wheels also prevent the skid steer from tipping forward and rocking, which is dangerous for the operator and can cause the wet cement to spill from the hopper. With the support wheels in the retracted position, the hopper attachment will rest on the base frame so that the attachment can be detached from the skid steer and filled with the wet cement.

The hopper attachment embodying the present invention described and illustrated herein is not intended to be exhaustive or to limit the invention to the precise form disclosed. It is presented to explain the invention so that others skilled in the art might utilize its teachings. The embodiment of the present invention may be modified within the scope of the following claims.

I claim:

1. A detachable utility attachment for a skid steer comprising:

a substantially horizontal base frame defining an open interior having opposed sides and a front;

a pair of uprights extending from the base frame from the side of the base frame a hopper mounted between the uprights and suspended above the base frame, the hopper having a front wall, an inclined bottom wall and inclined side walls and defining an interior for receiving contents therein, the front wall having an open mouth therein, the hopper includes an elongated chute extending outward from the front wall around the mouth, the hopper bottom wall and hopper side walls converge toward the mouth so as to provide an unobstructed view of the contents dispensed from the chute through the base frame from the skid steer when the attachment is mounted to the skid steer.

2. The attachment of claim 1 and a pair of wheels shiftably mounted to the uprights for movement between a retracted position where the wheels are raised above the base frame and an extended position where the wheels are extended below the base frame.

3. The attachment of claim 1 wherein the inclined bottom wall converges toward the mouth at an angle so that the chute is visible from the operators cabin of the skid steer.

4. The attachment of claim 1 wherein the hopper also includes a gate seated within the mouth for movement between an open position and closed position, and means for actuating the gate between the open and closed position to allow the contents within the hopper interior to be dispensed from the hopper.

5. The attachment of claim 1 and means mounted to the base frame for detachably mounting the attachment to the skid steer.

6. A detachable utility attachment for a skid steer comprising:

a substantially horizontal base frame defining an open interior having opposed sides and a front;

a pair of uprights extending from the base frame from the side of the base frame;

a hopper mounted between the uprights and suspended above the base frame, the hopper having a front wall, an inclined bottom wall and inclined side walls and defining an interior for receiving contents therein, the front wall having an open mouth therein, the hopper includes an elongated chute extending outward from the front wall around the mouth; and a pair of wheels shiftably mounted to the uprights for movement between a retracted position where the wheels are raised above the base frame and an extended position where the wheels are extended below the base frame.

7. The attachment of claim 6 wherein the hopper bottom wall and hopper side walls converge toward the mouth so as to provide an unobstructed view of the contents dispensed from the chute through the base frame from the skid steer when the attachment is mounted to the skid steer.

8. The attachment of claim 6 wherein the inclined bottom wall converges toward the mouth at an angle so that the chute is visible from the operators cabin of the skid steer.

9. The attachment of claim 6 wherein the hopper also includes a gate seated within the mouth for movement between an open position and closed position, and means for actuating the gate between the open and closed position to allow the contents within the hopper interior to be dispensed from the hopper.

10. The attachment of claim 6 and means mounted to the base frame for detachably mounting the attachment to the skid steer.

11. A detachable utility attachment for a skid steer comprising:

a substantially horizontal base frame defining an open interior having opposed sides and a front;

a pair of uprights extending from the base frame from the side of the base frame;

a hopper mounted between the uprights and suspended above the base frame, the hopper having a front wall, an inclined bottom wall and inclined side walls and defining an interior for receiving contents therein, the front wall having an open mouth therein, the hopper includes an elongated chute extending outward from the front wall around the mouth, the hopper bottom wall and hopper side walls converge toward the mouth so as to provide an unobstructed view of the contents dispensed from the chute through the base frame from the skid steer when the attachment is mounted to the skid steer, the hopper also includes a gate seated within the mouth for movement between an open position and closed position, and means for actuating the gate between the open and closed position to allow the contents within the hopper interior to be dispensed from the hopper;

a pair of wheels shiftably mounted to the uprights for movement between a retracted position where the wheels are raised above the base frame and an extended position where the wheels are extended below the base frame; and means mounted to the base frame for detachably mounting the attachment to the skid steer.

* * * * *